US005318728A

United States Patent [19]

Surutzidis et al.

[11] Patent Number: 5,318,728

[45] Date of Patent: Jun. 7, 1994

[54] LOW SUDSING POLYHYDROXY FATTY ACID AMIDE DETERGENTS

[75] Inventors: Athanasios Surutzidis, Wemmel; Jean-Pol Boutique, Gembloux, both of Belgium; Yi-Chang Fu, Wyoming, Ohio; Bruce P. Murch, Cincinnati, Ohio; Daniel S. Connor, Cincinnati, Ohio; Jeffrey J. Scheibel, Cincinnati, Ohio

[73] Assignee: The Procter & Gamble Company, Cincinnati, Ohio

[21] Appl. No.: 983,983

[22] Filed: Nov. 30, 1992

[51] Int. Cl.[5] ..... C11D 1/12; C11D 1/83; C11D 3/32; D06L 1/00

[52] U.S. Cl. ..... 252/548; 252/350; 252/DIG. 1; 8/137

[58] Field of Search ..... 252/548, 550, DIG. 1; 8/137

[56] References Cited

U.S. PATENT DOCUMENTS 2,703,798 3/1955 Schwartz ..... 252/548

FOREIGN PATENT DOCUMENTS 1580491 9/1969 France .
8304412 12/1983 World Int. Prop. O. .
9206156 4/1992 World Int. Prop. O. .

*Primary Examiner*—Paul Lieberman
*Assistant Examiner*—Erin M. Higgins
*Attorney, Agent, or Firm*—Jerry J. Yetter

[57] ABSTRACT

Low-sudsing detergent compositions comprise an N-alkyl polyhydroxy fatty acid amide surfactant, wherein the N-alkyl substituent is at least $C_2$, preferably $C_3$–$C_8$. Such compositions are useful under cleaning conditions where excessive sudsing may be problematic.

1 Claim, No Drawings

LOW SUDSING POLYHYDROXY FATTY ACID AMIDE DETERGENTS

FIELD OF THE INVENTION

The present invention relates to detergent compositions and processes which use specially selected polyhydroxy fatty acid amides to provide good cleaning with low suds levels. The compositions herein are useful under any circumstance where low sudsing is desired. Such uses include, for example, in front-loader "European" type fabric washing machines, in hard surface cleaners for walls, windows, etc., and in other cleaning operations where highly concentrated aqueous detergent liquors are used but where high sudsing could be problematic.

BACKGROUND OF THE INVENTION

The formulation of detergent compositions containing typical detersive surfactants necessarily results in products which have, to a more or less degree, the inherent tendency to form suds when the compositions are agitated in an aqueous medium. In many circumstances, the formation of suds is desirable, and consumers have come to expect high, rich suds in various shampoo, personal cleansing and hand dishwashing compositions. On the other hand, in certain other compositions the presence of suds can be problematic. For example, most hard surface cleansers are designed to have low suds levels, thereby obviating the need for extensive rinsing of the surfaces after the cleanser has been applied. Likewise, some washing machines, especially European-style front-loading machines which are designed to use substantially less water than the more familiar American style top-loading machines, typically employ higher concentrations of detersive surfactants. Suds levels must be kept low or else the suds can actually spill from such machines. A similar situation occurs with most automatic dishwashing machines where surfactant levels are kept very low and suds controlling agents are used extensively to provide a nearly sudsless cleaning of dishware. Low sudsing can also be advantageous in concentrated laundering processes such as those described in U.S. Pat. Nos. 4,489,455 and 4,489,574.

Considerable attention has lately been directed to the polyhydroxy fatty acid amide class of nonionic surfactants. These surfactants have the advantage that they can be prepared using mainly renewable resources, such as fatty acid esters and sugars, and thereby provide substantial advantages to the formulators of detergent compositions who are seeking non-petrochemical, renewable resources for the manufacture of detersive surfactants. Moreover, the polyhydroxy fatty acid amides exhibit particularly good cleaning performance, especially when used in conjunction with various anionic surfactants. There is considerable impetus to begin using polyhydroxy fatty acid amide surfactants in commercial cleaning compositions of all types.

Unfortunately, many of the polyhydroxy fatty acid amide surfactants are suds boosters and stabilizers, especially when used in combination with conventional anionic surfactants. Accordingly, the formulator of low sudsing detergent compositions either must curtail the use of this desirable class of surfactants when formulating low sudsing detergents, or must use relatively high amounts of suds controlling agents in such compositions.

By the present invention, it has been unexpectedly determined that certain members of the class of polyhydroxy fatty acid amides provide good cleaning performance, but do not undesirably enhance sudsing. Indeed, it has been further discovered that the aforesaid "low sudsing" polyhydroxy fatty acid amide surfactants can actually diminish the sudsing of their counterpart high sudsing polyhydroxy fatty acid amide surfactants. This sub-class of low sudsing polyhydroxy fatty acid amides is employed in the practice of this invention to provide low sudsing compositions for use under circumstances where, as disclosed above, low sudsing is desired.

BACKGROUND ART

A method for preparing crude polyhydroxy fatty acid amides (glucamides) is described in U.S. Pat. No. 1,985,424, Piggott, and in U.S. Pat. No. 2,703,798, Schwartz. The use of such glucamides with various synthetic anionic surfactants is described in U.S. Pat. No. 2,965,576, corresponding to G.B. Patent 809,060. See also U.S. Pat. No. 3,764,531. Eckert et al, Oct. 9, 1973 amd French 1,580,491. The sulfuric esters of acylated glucamines are disclosed in U.S. Pat. No. 2,717,894, Schwartz.

SUMMARY OF THE INVENTION

The present invention encompasses low sudsing detergent compositions comprising at least about 2%, typically 2% to about 60% of an N-alkyl polyhydroxy fatty acid amide and one or more auxiliary detersive surfactants, wherein said N-alkyl polyhydroxy fatty acid amide has N-alkyl substituents in the range Of $C_2$–$C_8$ and is substantially free of N-hydrogen, N-methyl, and N-hydroxyalkyl substituents. For solubility reasons, and to achieve the desired low sudsing benefit, preferred compositions herein are those wherein the total number of carbon atoms in the N-alkyl substituent plus fatty acid substituent is no greater than about 20, and no less than about 12.

Included among such compositions herein are those where the N-alkyl substituent is a member selected from the group consisting of ethyl, n-propyl, isopropyl, n-butyl, isobutyl, n-pentyl, n-hexyl, cyclohexyl, 2-ethylhexyl, and the like. Typical of such compositions are those which contain at least about 2% by weight of a member selected from the group consisting of the $C_{12}$–$C_{18}$ fatty acid esters of N-n-propyl glucamide, N-n-propyl fructamide, N-n-propyl xylamide, and mixtures thereof, or, in less preferred compositions, the corresponding N-ethyl compound.

In some circumstances, the low sudsing qualities of the N-ethyl compound may not be optimal. On balance, and considering its high grease removal performance and low sudsing qualities, the N-n-propyl compound, N-isopropyl, N-n-butyl and N-isobutyl compounds are preferred materials for use herein. Thus, compositions and methods which employ a member selected from the group consisting of the $C_{12}$–$C_{18}$ fatty acid esters of the N-n-propyl, N-n-butyl and N-isobutyl glucamides, fructamides and xylamides, and mixtures thereof, are preferred herein. The N-n-hexyl compounds are useful, especially under European washing conditions at somewhat elevated temperatures.

It has surprisingly been determined that the N-alkyl polyhydroxy fatty acid amide low sudsers of this invention can also be used to diminish the high sudsing levels of the N-methyl and N-hydroxyalkyl polyhydroxy fatty acid amide high sudsers. Thus, the low sudser amides can, if desired, be used in combination with high sudser amides to provide overall low-to-moderate sudsing detergent compositions. Such compositions can employ from about 2% to about 60% of high+low sudsers, a weight ratio of high sudser:low sudser as much as about 30:1, typically in the range of about 3:1 to about 1:3, and preferably have a high:low sudser ratio less than 1:1, most preferably 0.5:1 or lower.

Preferred compositions herein are those which contain an auxiliary detersive surfactant and other detersive adjuncts, as disclosed hereinafter, especially auxiliary suds control agents.

The invention also encompasses method for cleaning fabrics in an automatic washing machine without excess sudsing comprising contacting the fabrics to be laundered with an aqueous solution (typically, at least about 100 ppm) of the low sudsing detergent compositions provided herein.

The invention also encompasses a method for cleaning hard surfaces without excessive sudsing, comprising contacting the surface to be cleaned with a low sudsing detergent according to this invention, preferably in the presence of water.

All percentages, ratios and proportions herein are by weight. All documents cited are incorporated herein by reference.

DETAILED DESCRIPTION OF THE INVENTION

The present invention provides low sudsing detergent compositions which contain selected members of the class of polyhydroxy fatty acid amide nonionic surfactants. By "low sudsing" herein is meant a suds height or suds volume for the low sudsing detergent compositions herein containing the N-$C_2C_8$ alkyl polyhydroxy fatty acid amide surfactant which is substantially less than that which is achieved in comparable compositions containing the N-methyl polyhydroxy fatty acid amide surfactant and none of the N-$C_2$–$C_8$ materials. Typically, the compositions herein provide sudsing which is no greater, on average, than about 70%, preferably no greater than about 50%, of that produced with the N-methyl surfactants. Of course, the sudsing can be still further reduced by means of standard suds control agents such as the silicones, various fatty materials and the like.

For the convenience of the formulator, a useful test procedure for comparing the sudsing of the low-suds compositions herein is provided hereinafter. The test comprises agitating aqueous solutions containing the detergent being tested in a standardized fashion and comparing sudsing against equivalent detergents containing the N-methyl polyhydroxy fatty acid amide. This particular test is run at ambient temperature (ca. 23° C.) and at 60° C., and at water hardness (3:1 Ca:Mg) levels of 10.4 gr/gal (179 ppm) and 25 gr/gal (428 ppm) to mimic a wide variety of prospective usage conditions. Of course, the formulator may modify the test conditions to focus on prospective usage conditions and user habits and practices throughout the world.

Sudsing Test

Suds cylinders having the dimensions 12 inch (30.4 cm) height and 4 inch (10.16 cm) diameter are releasably attached to a machine which rotates the cylinders 360° around a fixed axis. A typical test uses four cylinders, two for the standard comparison detergent product and two for the low sudsing detergent test product.

In the test, 500 mL of aqueous solution of the respective detergents is placed in the cylinders. Conveniently, the solutions comprise 3 g of the detergent, but other amounts can be used. The temperature of the solutions and their hardness are adjusted as noted above. Typically, $CaCl_2$ and $MgCl_2$ salts are used to supply hardness. The cylinders are sealed and the 500 ml level marked with tape. The cylinders are rotated through two complete revolutions, stopped and vented.

After the foregoing preparatory matters have been completed, the test begins. The cylinders are allowed to rotate 360° on the machine at a rate of 30 revolutions per minute. The machine is stopped at one minute intervals, the suds height from the top of the solution to the top of the suds is measured, and the machine is restarted. The test proceeds thusly for 10 minutes. A suds "volume" is calculated by taking the average suds height over the test time (10 minutes) and can be expressed as suds volume per minute (cm), which conforms with: suds volume per minute=sum of suds height at each time of measurement divided by total time (10 minutes).

It is to be understood that the foregoing test provides a relative comparison between low sudsing detergent compositions of the type provided herein vs. standard comparison products. Stated otherwise, absolute values of suds heights are meaningless, since they can vary widely with solution temperature and water hardness. To illustrate this point further, an N-n-propyl polyhydroxy fatty acid amide (low sudser) exhibits suds volumes per minute in the above test of: 0.5 cm at T=ambient, hardness 10.4; 2.1 cm at T=ambient, hardness 25. In comparison, the respective figures for a tallowalkyl N-methyl glucamide (high sudser) are 1 cm and 3.3 cm.

Ingredients

While the polyhydroxy fatty acid amides used herein can be prepared, for example, by the methods disclosed in the Schwartz or Piggott references above, this invention most preferably employs high quality polyhydroxy fatty acid amide surfactants which are substantially free of cyclized by-products.

As an overall proposition, the preparative methods described in WO-9,206,154 and WO-9,206,984 will afford high quality polyhydroxy fatty acid amides. The methods comprise reacting N-alkylamino polyols with, preferably, fatty acid methyl esters in a solvent using an alkoxide catalyst at temperatures of about 85° C. to provide high yields (90–98%) of polyhydroxy fatty acid amides having desirable low levels (typically, less than about 1.0%) of sub-optimally degradable cyclized by-products and also with improved color and improved color stability, e.g., Gardner Colors below about 4, preferably between 0 and 2. (With some of the low sudsers, e.g., n-butyl, iso-butyl, n-hexyl, the methanol introduced via the catalyst or generated during the reaction provides sufficient fluidization that the use of additional reaction solvent may be optional.) Use of N-$C_2$–$C_8$ alkylamino polyols yields low-sudsing compounds of the type employed herein. If desired, any unreacted N-alkylamino polyol remaining in the product can be acylated with an acid anhydride, e.g., acetic anhydride, maleic anhydride, or the like, to minimize the overall level of amines in the product.

By "cyclized by-products" herein is meant the undesirable reaction by-products of the primary reaction wherein it appears that the multiple hydroxyl groups in the polyhydroxy fatty acid amides can form ring structures which may not be readily biodegradable. It will be appreciated by those skilled in the chemical arts that the preparation of the polyhydroxy fatty acid amides herein using the di- and higher saccharides such as maltose will result in the formation of polyhydroxy fatty acid amides wherein linear substituent Z (which contains multiple hydroxy substituents) is naturally "capped" by a polyhydroxy ring structure. Such materials are not cyclized by-products, as defined herein.

More specifically, the compositions and processes herein employ polyhydroxy fatty acid amide surfactants of the formula:

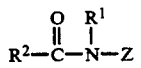

(I)

wherein: $R^1$ is $C_2$–$C_8$, preferably $C_3$–$C_6$ hydrocarbyl (straight chain, branched chain or cyclic), or a mixture thereof; and $R^2$ is a $C_5$–$C_{31}$ hydrocarbyl moiety, preferably straight chain $C_7$–$C_{19}$ alkyl or alkenyl, more preferably straight chain $C_9$–$C_{17}$ alkyl or alkenyl, most preferably straight chain $C_{11}$–$C_{19}$ alkyl or alkenyl, or mixture thereof; and Z is a polyhydroxyhydrocarbyl moiety having a linear hydrocarbyl chain with at least 2 (in the case of glyceraldehyde) or at least 3 hydroxyls (in the case of other reducing sugars) directly connected to the chain. Z preferably will be derived from a reducing sugar in a reductive amination reaction; more preferably Z is a glycityl moiety. Suitable reducing sugars include glucose, fructose, maltose, lactose, galactose, mannose, and xylose, as well as glyceraldehyde. As raw materials, high dextrose corn syrup, high fructose corn syrup, and high maltose corn syrup can be utilized as well as the individual sugars listed above. These corn syrups may yield a mix of sugar components for Z. It should be understood that it is by no means intended to exclude other suitable raw materials. Z preferably will be selected from the group consisting of $—CH_2—(CHOH)_n—CH_2OH$, $—CH(CH_2OH)—(CHOH)_{n-1}—CH_2OH$, $—CH_2—(CHOH)_2(CHOR')(CHOH)—CH_2OH$, where n is an integer from 1 to 5, inclusive, and R' is H or a cyclic mono- or poly- saccharide. Most preferred are glycityls wherein n is 4, particularly $—CH_2—(CHOH)_4—CH_2OH$.

In Formula (I), $R^1$ can be, for example, N-ethyl, N-n-propyl, N-isopropyl, N-n-butyl, N-isobutyl, N-cyclopentyl, N-cyclohexyl, N-octyl, N-2-ethyl hexyl and the like.

$R^2$-CO-N< can be, for example, cocamide, stearamide, oleamide, lauramide, myristamide, capricamide, palmitamide, tallowamide, oleylamide, etc.

Z can be 1-deoxyglucityl, 2-deoxyfructityl, 1-deoxyxylityl, 1-deoxymaltityl, 1-deoxylactityl, 1-deoxygalactityl, 1-deoxymannityl, 1-deoxymaltotriotityl, 2,3-dihydroxypropyl (from glyceraldehyde), etc.

It will be appreciated that the polyhydroxy fatty acid amide surfactants used herein as the nonionic surfactant component can be mixtures of materials having various substituents $R^1$ and $R^2$.

It is to be understood that various "detersive adjunct" materials will typically be used in fully-formulated detergent compositions containing the low sudsing surfactants of the present invention. Such adjuncts will vary, depending on the intended end-use of the final compositions. The following are intended only to be nonlimiting illustrations of such adjuncts, more examples of which will readily come to mind of the skilled formulator.

Surfactants

The laundry and dishwashing compositions herein will optionally, but most preferably, comprise from about 3% to about 60% by weight of additional, known detersive surfactants, especially anionic surfactants. If desired to help maintain very low suds levels, the compositions herein should also contain suds suppressors as noted hereinafter, especially when high levels (e.g., 20–30%) of high sudsing surfactants are present in the compositions.

Nonlimiting examples of optional (albeit high sudsing) surfactants useful herein include the conventional $C_{11}$–$C_{16}$ alkyl benzene sulfonates, the $C_{12}$–$C_{18}$ primary and secondary alkyl sulfates and $C_{12}$–$C_{18}$ unsaturated (alkenyl) sulfates such as oleyl sulfate, the $C_{10}$–$C_{18}$ alkyl alkoxy sulfates (especially ethoxy sulfates), the $C_{10}$–$C_{18}$ alkyl polyglycosides and their corresponding sulfated polyglycosides, $C_{12}$–$C_{18}$ alpha-sulfonated fatty acid esters, $C_{12}$–$C_{18}$ alkyl and alkyl phenol alkoxylates (especially ethoxy and mixed ethoxy/propoxy), $C_{12}$–$C_{18}$ betaines and sulfobetaines, $C_{10}$–$C_{18}$ amine oxides, and the like, having due regard for the effects on sudsing noted above. Polyhydroxy fatty acid amides wherein $R^1$ is methyl can also be used. Other conventional useful surfactants are listed in standard texts.

Enzymes

Detersive enzymes can optionally be included in the detergent formulations for a wide variety of purposes, especially for fabric laundering, including removal of protein-based, carbohydrate-based, or triglyceride-based stains, for example, and prevention of refugee dye transfer. The enzymes to be incorporated include proteases, amylases, lipases, cellulases, and peroxidases, as well as mixtures thereof. Other types of enzymes may also be included. They may be of any suitable origin, such as vegetable, animal, bacterial, fungal and yeast origin. However, their choice is governed by several factors such as ph-activity and/or stability optima, thermostability, stability versus active detergents, builders and so on. In this respect bacterial or fungal enzymes are preferred, such as bacterial amylases and proteases, and fungal cellulases.

Enzymes are normally incorporated at levels sufficient to provide up to about 5 mg by weight, more typically about 0.05 mg to about 3 mg, of active enzyme per gram of the composition.

Suitable examples of proteases are the subtilisins which are obtained from particular strains of B.subtilis and B.licheniforms. Another suitable protease is obtained from a strain of Bacillus, having maximum activity throughout the pH range of 8–12, developed and sold by Novo Industries A/S under the registered trade name ESPERASE. The preparation of this enzyme and analogous enzymes is described in British Patent Specification No. 1,243,784 of Novo. Proteolytic enzymes suitable for removing protein-based stains that are commercially available include those sold under the tradenames ALCALASE and SAVINASE by Novo Industries A/S (Denmark) and MAXATASE by International Bio-Synthetics, Inc. (The Netherlands). Other proteases include Protease A (see European Patent Application 130,756, published Jan. 9, 1985) and Protease B (see European Patent Application Serial No. 87303761.8, filed Apr. 28, 1987, and European Patent Application 130,756, Bott et al, published Jan. 9, 1985).

Amylases include, for example, α-amylases described in British Patent Specification No. 1,296,839 (Novo), RAPIDASE, International Bio-Synthetics, Inc. and TERMAMYL, Novo Industries.

The cellulases usable in the present invention include both bacterial or fungal cellulase. Preferably, they will have a pH optimum of between 5 and 9.5. Suitable cellulases are disclosed in U.S. Pat. No. 4,435,307, Barbesgoard et al, issued Mar. 6, 1984, which discloses fungal cellulase produced from Humicola insolens and Humicola strain DSM1800 or a cellulase 212-producing fungus belonging to the genus Aeromonas, and cellulase extracted from the hepatopancreas of a marine mollusk (Dolabella Auricula Solander). Suitable cellulases are also disclosed in GB-A-2.075.028; GB-A-2.095.275 and DE-OS-2.247.832.

Suitable lipase enzymes for detergent usage include those produced by microorganisms of the Pseudomonas group, such as Pseudomonas stutzeri ATCC 19.154, as disclosed in British Patent 1,372,034. See also lipases in Japanese Patent Application 53-20487, laid open to public inspection on Feb. 24, 1978. This lipase is available from Amano Pharmaceutical Co. Ltd., Nagoya, Japan, under the trade name Lipase P "Amano," hereinafter referred to as "Amano-P." Other commercial lipases include Amano-CES, lipases ex *Chromobacter viscosum*, e.g. *Chromobacter viscosum* var. *lipolyticum* NRRLB 3673, commercially available from Toyo Jozo Co., Tagata, Japan; and further *Chromobacter viscosum* lipases from U.S. Biochemical Corp., U.S.A. and Disoynth Co., The Netherlands, and lipases ex *Pseudomonas gladioli.*

Peroxidase enzymes are used in combination with oxygen sources, e.g., percarbonate, perborate, persulfate, hydrogen peroxide, etc. They are used for "solution bleaching," i.e. to prevent transfer of dyes or pigments removed from substrates during wash operations to other substrates in the wash solution. Peroxidase enzymes are known in the art, and include, for example, horseradish peroxidase, ligninase, and haloperoxidase such as chloro- and bromo-peroxidase. Peroxidase-containing detergent compositions are disclosed, for example, in PCT International Application WO 89/099813, published Oct. 19, 1989, by O. Kirk, assigned to Novo Industries A/S.

A wide range of enzyme materials and means for their incorporation into synthetic detergent granules is also disclosed in U.S. Pat. No. 3,553,139, issued Jan. 5, 1971 to McCarty et al (). Enzymes are further disclosed in U.S. Pat. No. 4,101,457, Place et al, issued Jul. 18, 1978, and in U.S. Pat. No. 4,507,219, Hughes, issued Mar. 26, 1985, both. Enzyme materials useful for liquid detergent formulations, and their incorporation into such formulations, are disclosed in U.S. Pat. No. 4,261,868, Hora et al, issued Apr. 14, 1981. Enzymes for use in detergents can be stabilized by various techniques. Enzyme stabilization techniques are disclosed and exemplified in U.S. Pat. No. 4,261,868, issued Apr. 14, 1981 to Horn, et al, U.S. Pat. No. 3,600,319, issued Aug. 17, 1971 to Gedge, et al, and European Patent Application Publication No. 0 199 405, Application No. 86200586.5, published Oct. 29, 1986, Venegas. Enzyme stabilization systems are also described, for example, in U.S. Pat. Nos. 4,261,868, 3,600,319, and 3,519,570.

Builders

Detergent builders can optionally be included in the compositions herein to assist in controlling mineral hardness. Inorganic as well as organic builders can be used. Builders are typically used in fabric laundering compositions to assist in the removal of particulate soils.

The level of builder can vary widely depending upon the end use of the composition and its desired physical form. When present, the compositions will typically comprise at least about 1% builder. Liquid formulations typically comprise from about 5% to about 50%, more typically about 5% to about 30%, by weight, of detergent builder. Granular formulations typically comprise from about 10% to about 80%, more typically from about 15% to about 50% by weight, of the detergent builder. Lower or higher levels of builder, however, are not meant to be excluded.

Inorganic detergent builders include, but are not limited to, the alkali metal, ammonium and alkanolammonium salts of polyphosphates (exemplified by the tripolyphosphates, pyrophosphates, and glassy polymeric meta-phosphates), phosphonates, phytic acid, silicates, carbonates (including bicarbonates and sesquicarbonates), sulphates, and aluminosilicates. However, non-phosphate builders are required in some locales. Importantly, the compositions herein function surprisingly well even in the presence of the so-called "weak" builders (as compared with phosphates) such as citrate, or in the so-called "underbuilt" situation that may occur with zeolite or layered silicate builders.

Examples of silicate builders are the alkali metal silicates, particularly those having a $SiO_2$:$Na_2O$ ratio in the range 1.6:1 to 3.2:1 and layered silicates, such as the layered sodium silicates described in U.S. Pat. No. 4,664,839, issued May 12, 1987 to H. P. Rieck. However, other silicates may also be useful such as for example magnesium silicate, which can serve as a crispening agent in granular formulations, as a stabilizing agent for oxygen bleaches, and as a component of suds control systems.

Examples of carbonate builders are the alkaline earth and alkali metal carbonates as disclosed in German Patent Application No. 2,321,001 published on Nov. 15, 1973.

Aluminosilicate builders are especially useful in the present invention. Aluminosilicate builders are of great importance in most currently marketed heavy duty granular detergent compositions, and can also be a significant builder ingredient in liquid detergent formulations. Aluminosilicate builders include those having the empirical formula:

$$M_z(zAlO_2.ySiO_2)$$

wherein M is sodium, potassium, ammonium or substituted ammonium, z is from about 0.5 to about 2; and y is 1; this material having a magnesium ion exchange capacity of at least about 50 milligram equivalents of $CaCO_3$ hardness per gram of anhydrous aluminosilicate. Preferred aluminosilicates are zeolite builders which have the formula:

$$Na_z[AlO_2)_z(SiO_2)_y].xH_2O$$

wherein z and y are integers of at least 6, the molar ratio of z to y is in the range from 1.0 to about 0.5, and x is an integer from about 15 to about 264.

Useful aluminosilicate ion exchange materials are commercially available. These aluminosilicates can be crystalline or amorphous in structure and can be naturally-occurring aluminosilicates or synthetically derived. A method for producing aluminosilicate ion exchange materials is disclosed in U.S. Pat. No. 3,985,669, Krummel, et al, issued Oct. 12, 1976. Preferred synthetic crystalline aluminosilicate ion exchange materials useful herein are available under the designations Zeolite A, Zeolite P (B), and Zeolite X. In an especially preferred embodiment, the crystalline aluminosilicate ion exchange material has the formula:

$$Na_{12}[AlO_2)_{12}(SiO_2)_{12}].xH_2O$$

wherein x is from about 20 to about 30, especially about 27. This material is known as Zeolite A. Preferably, the aluminosilicate has a particle size of about 0.1-10 microns in diameter.

Organic detergent builders suitable for the purposes of the present invention include, but are not restricted to, a wide variety of polycarboxylate compounds. As used herein, "polycarboxylate" refers to compounds having a plurality of carboxylate groups, preferably at least 3 carboxylates. Polycarboxylate builder can generally be added to the composition in acid form, but can also be added in the form of a neutralized salt. When utilized in salt form, alkali metals, such as sodium, potassium, and lithium, or alkanolammonium salts are preferred.

Included among the polycarboxylate builders are a variety of categories of useful materials. One important category of polycarboxylate builders encompasses the ether polycarboxylates, including oxydisuccinate, as disclosed in Berg, U.S. Pat. No. 3,128,287, issued Apr. 7, 1964, and Lamberti et al, U.S. Pat. No. 3,635,830, issued Jan. 18, 1972. See also "TMS/TDS" builders of U.S. Pat. No. 4,663,071, issued to Bush et al, on May 5, 1987. Suitable ether polycarboxylates also include cyclic compounds, particularly alicyclic compounds, such as those described in U.S. Pat. Nos. 3,923,679; 3,835,163; 4,158,635; 4,120,874 and 4,102,903.

Other useful detergency builders include the ether hydroxypolycarboxylates, copolymers of maleic anhydride with ethylene or vinyl methyl ether, 1, 3, 5-trihydroxy benzene-2, 4, 6-trisulphonic acid, and carboxymethyloxysuccinic acid, the various alkali metal, ammonium and substituted ammonium salts of polyacetic acids such as ethylenediamine tetraacetic acid and nitrilotriacetic acid, as well as polycarboxylates such as mellitic acid, succinic acid, oxydisuccinic acid, polymaleic acid, benzene 1,3,5-tricarboxylic acid, carboxymethyloxysuccinic acid, and soluble salts thereof.

Citrate builders, e.g., citric acid and soluble salts thereof (particularly sodium salt), are polycarboxylate builders of particular importance for heavy duty liquid detergent formulations due to their availability from renewable resources and their biodegradability. Citrates can also be used in granular compositions, especially in combination with zeolite and/or layered silicate builders.

Also suitable in the detergent compositions of the present invention are the 3,3-dicarboxy-4-oxa-1,6-hexanedioates and the related compounds disclosed in U.S. Pat. No. 4,566,984, Bush, issued Jan. 28, 1986. Useful succinic acid builders include the $C_5$-$C_{20}$ alkyl and alkenyl succinic acids and salts thereof. A particularly preferred compound of this type is dodecenylsuccinic acid. Specific examples of succinate builders include: laurylsuccinate, myristylsuccinate, palmitylsuccinate, 2-dodecenylsuccinate (preferred), 2-pentadecenylsuccinate, and the like. Laurylsuccinates are the preferred builders of this group, and are described in European Patent Application 86200690.5/0,200,263, published Nov. 5, 1986.

Other suitable polycarboxylates are disclosed in U.S. Pat. No. 4,144,226, Crutchfield et al, issued Mar. 13, 1979 and in U.S. Pat. No. 3,308,067, Diehl, issued Mar. 7, 1967. See also Diehl U.S. Pat. No. 3,723,322.

Fatty acids, e.g., $C_{12}$-$C_8$ monocarboxylic acids, can also be incorporated into the compositions alone, or in combination with the aforesaid builders, especially citrate and/or the succinate builders, to provide additional builder activity. Such use of fatty acids will generally result in a diminution of sudsing, which should be taken into account by the formulator.

In situations where phosphorus-based builders can be used, the various alkali metal phosphates such as the well known sodium tripolyphosphates, sodium pyrophosphate and sodium orthophosphate can be used. Phosphonate builders such as ethane-1-hydroxy-1,1-diphosphonate and other known phosphonates (see, for example, U.S. Pat. Nos. 3,159,581; 3,213,030; 3,422,021; 3,400,148 and 3,422,137) can also be used.

Bleaching Compounds—Bleaching Agents and Bleach Activators

The detergent compositions herein may optionally contain bleaching agents or bleaching compositions containing a bleaching agent and one or more bleach activators. When present, bleaching agents will typically be at levels of from about 1% to about 20%, more typically from about 1% to about 10%, of the detergent composition, especially for fabric laundering. If present, the amount of bleach activators will typically be from about 0.1% to about 60%, more typically from about 0.5% to about 40% of the bleaching composition comprising the bleaching agent-plus-bleach activator.

The bleaching agents used herein can be any of the bleaching agents useful for detergent compositions in textile cleaning, hard surface cleaning, or other cleaning purposes that are now known or become known. These include oxygen bleaches as well as other bleaching agents. Perborate bleaches, e.g., sodium perborate (e.g., mono- or tetra-hydrate) can be used herein, but, under some conditions, may undesirably interact with the polyol nonionic surfactant.

One category of bleaching agent that can be used without restriction encompasses percarboxylic ("percarbonate") acid bleaching agents and salts therein. Suitable examples of this class of agents include magnesium monoperoxyphthalate hexahydrate, the magnesium salt of meta-chloro perbenzoic acid, 4-nonylamino-4-oxoperoxybutyric acid and diperoxydodecanedioic acid. Such bleaching agents are disclosed in U.S. Pat. No. 4,483,781, Hartman, issued Nov. 20, 1984, U.S. patent application Ser. No. 740,446, Burns et al, filed Jun. 3, 1985, European Patent Application 0,133,354, Banks et al, published Feb. 20, 1985, and U.S. Pat. No. 4,412,934, Chung et al, issued Nov. 1, 1983. Highly preferred bleaching agents also include 6-nonylamino-6-oxoperoxycaproic acid as described in U.S. Pat. No. 4,634,551, issued Jan. 6, 1987 to Burns et al.

Peroxygen bleaching agents can also be used. Suitable peroxygen bleaching compounds include sodium carbonate peroxyhydrate, sodium pyrophosphate peroxyhydrate, urea peroxyhydrate, and sodium peroxide. Persulfate bleach (e.g., OXONE, manufactured commercially by DuPont) can also be used.

Mixtures of bleaching agents can also be used.

Peroxygen bleaching agents and the perborates are preferably combined with bleach activators, which lead to the in situ production in aqueous solution (i.e., during the washing process) of the peroxy acid corresponding to the bleach activator. Various nonlimiting examples of activators are disclosed in U.S. Pat. No. 4,915,854, issued Apr. 10, 1990 to Mao et al, and U.S. Pat. No. 4,412,934. The nonanoyloxybenzene sulfonate (NOBS) and tetraacetyl ethylene diamine (TAED) activators are typical , and mixtures thereof can also be used. See also U.S. Pat. No. 4,634,551 for other typical bleaches and activators useful herein.

Bleaching agents other than oxygen bleaching agents are also known in the art and can be utilized herein. One type of nonoxygen bleaching agent of particular interest includes photoactivated bleaching agents such as the sulfonated zinc and/or aluminum phthalocyanines. See U.S. Pat. No. 4,033,718, issued Jul. 5, 1977 to Holcombe et al. Typically, detergent compositions will contain about 0.025% to about 1.25%, by weight, of sulfonated zinc phthalocyanine.

Polymeric Soil Release Agent

Any polymeric soil release agent known to those skilled in the art can optionally be employed in the compositions and processes of this invention. Polymeric soil release agents are characterized by having both hydrophilic segments, to hydrophilize the surface of hydrophobic fibers, such as polyester and nylon, and hydrophobic segments, to deposit upon hydrophobic fibers and remain adhered thereto through completion of washing and rinsing cycles and, thus, serve as an anchor for the hydrophilic segments. This can enable stains occurring subsequent to treatment with the soil release agent to be more easily cleaned in later washing procedures.

The polymeric soil release agents for which performance is enhanced herein especially include those soil release agents having: (a) one or more nonionic hydrophile components consisting essentially of (i) polyoxyethylene segments with a degree of polymerization of at least 2, or (ii) oxypropylene or polyoxypropylene segments with a degree of polymerization of from 2 to 10, wherein said hydrophile segment does not encompass any oxypropylene unit unless it i s bonded to adjacent moieties at each end by ether linkages, or (iii) a mixture of oxyalkylene units comprising oxyethylene and from 1 to about 30 oxypropylene units wherein said mixture contains a sufficient amount of oxyethylene units such that the hydrophile component has hydrophilicity great enough to increase the hydrophilicity of conventional polyester synthetic fiber surfaces upon deposit of the soil release agent on such surface, said hydrophile segments preferably comprising at least about 25% oxyethylene units and more preferably, especially for such components having about 20 to 30 oxypropylene units, at least about 50% oxyethylene units; or (b) one or more hydrophobe components comprising (i) $C_3$ oxyalkylene terephthalate segments, wherein, if said hydrophobe components also comprise oxyethylene terephthalate, the ratio of oxyethylene terephthalate:$C_3$ oxyalkylene terephthalate units is about 2:1 or lower, (ii) $C_4$–$C_6$ alkylene or oxy $C_4$–$C_6$ alkylene segments, or mixtures therein, (iii) poly (vinyl ester) segments, preferably poly(vinyl acetate), having a degree of polymerization of at least 2, or (iv) $C_1$–$C_4$ alkyl ether or $C_4$ hydroxyalkyl ether substituents, or mixtures therein, wherein said substituents are present in the form of $C_1$–$C_4$ alkyl ether or $C_4$ hydroxyalkyl ether cellulose derivatives, or mixtures therein, and such cellulose derivatives are amphiphilic, whereby they have a sufficient level of $C_1$–$C_4$ alkyl ether and/or $C_4$ hydroxyalkyl ether units to deposit upon conventional polyester synthetic fiber surfaces and retain a sufficient level of hydroxyls, once adhered to such conventional synthetic fiber surface, to increase fiber surface hydrophilicity, or a combination of (a) and (b).

Typically, the polyoxyethylene segments of (a)(i) will have a degree of polymerization of from 2 to about 200, although higher levels can be used, preferably from 3 to about 150, more preferably from 6 to about 100. Suitable oxy $C_4$–$C_6$ alkylene hydrophobe segments include, but are not limited to, end-caps of polymeric soil release agents such as $MO_3S(CH_2)_nOCH_2CH_2O$—, where M is sodium and n is an integer from 4–6, as disclosed in U.S. Pat. No. 4,721,580, issued Jan. 26, 1988 to Gosselink.

Polymeric soil release agents useful in the present invention also include cellulosic derivatives such as hydroxyether cellulosic polymers, copolymeric blocks of ethylene terephthalate or propylene terephthalate with polyethylene oxide or polypropylene oxide terephthalate, and the like. Such agents are commercially available and include hydroxyethers of cellulose such as METHOCEL (Dow). Cellulosic soil release agents for use herein also include those selected from the group consisting of $C_1$–$C_4$ alkyl and $C_4$ hydroxyalkyl cellulose; see U.S. Pat. No. 4,000,093, issued Dec. 28, 1976 to Nicol, et al.

Soil release agents characterized by poly(vinyl ester) hydrophobe segments include graft copolymers of poly(vinyl ester), e.g., $C_1$–$C_6$ vinyl esters, preferably poly(vinyl acetate) grafted onto polyalkylene oxide backbones, such as polyethylene oxide backbones. See European Patent Application 0 219 048, published Apr. 22, 1987 by Kud, et al. Commercially available soil release agents of this kind include the SOKALAN type of material, e.g., SOKALAN HP-22, available from BASF (West Germany).

One type of preferred soil release agent is a copolymer having random blocks of ethylene terephthalate and polyethylene oxide (PEO) terephthalate. The molecular weight of this polymeric soil release agent is in the range of from about 25,000 to about 55,000. See U.S. Pat. No. 3,959,230 to Hays, issued May 25, 1976 and U.S. Pat. No. 3,893,929 to Basadur issued Jul. 8, 1975.

Another preferred polymeric soil release agent is a polyester with repeat units of ethylene terephthalate units containing 10–15% by weight of ethylene terephthalate units together with 90–80% by weight of polyoxyethylene terephthalate units, derived from a polyoxyethylene glycol of average molecular weight 300–5,000. Examples of this polymer include the commercially available material ZELCON 5126 (from Dupont) and MILEASE T (from ICI). See also U.S. Pat. No. 4,702,857, issued Oct. 27, 1987 to Gosselink.

Another preferred polymeric soil release agent is a sulfonated product of a substantially linear ester oligomer comprised of an oligomeric ester backbone of terephthaloyl and oxyalkyleneoxy repeat units and terminal moieties covalently attached to the backbone. These soil release agents are described fully in U.S. Pat. No. 4,968,451, issued Nov. 6, 1990 to J. J. Scheibel and E. P. Gosselink.

Other suitable polymeric soil release agents include the terephthalate polyesters of U.S. Pat. No. 4,711,730, issued Dec. 8, 1987 to Gosselink et al, the anionic end-capped oligomeric esters of U.S. Pat. No. 4,721,580, issued Jan. 26, 1988 to Gosselink, and the block polyester oligomeric compounds of U.S. Pat. No. 4,702,857, issued Oct. 27, 1987 to Gosselink.

Preferred polymeric soil release agents also include the soil release agents of U.S. Pat. No. 4,877,896, issued Oct. 31, 1989 to Maldonado et al, which discloses anionic, especially sulfoaroyl, end-capped terephthalate esters.

If utilized, soil release agents will generally comprise from about 0.01% to about 10.0%, by weight, of the detergent compositions herein, typically from about 0.1% to about 5%, preferably from about 0.2% to about 3.0%.

Chelating Agents

The detergent compositions herein may also optionally contain one or more iron and/or manganese chelating agents. Such chelating agents can be selected from the group consisting of amino carboxylates, amino phosphonates, polyfunctionally-substituted aromatic chelating agents and mixtures therein, all as hereinafter defined. Without intending to be bound by theory, it is believed that the benefit of these materials is due in part to their exceptional ability to remove iron and manganese ions from washing solutions by formation of soluble chelates.

Amino carboxylates useful as optional chelating agents include ethylenediaminetetraacetates, N-hydroxyethylethylenediaminetriacetates, nitrilotriacetates, ethylenediamine tetraproprionates, triethylenetetraaminehexaacetates, diethylenetriaminepentaacetates, and ethanoldiglycines, alkali metal, ammonium, and substituted ammonium salts therein and mixtures therein.

Amino phosphonates are also suitable for use as chelating agents in the compositions of the invention when at least low levels of total phosphorus are permitted in detergent compositions, and include ethylenediaminetetrakis (methylenephosphonates), nitrilotris (methylenephosphonates) and diethylenetriaminepentakis (methylenephosphonates). Preferably, these amino phosphonates do not contain alkyl or alkenyl groups with more than about 6 carbon atoms.

Polyfunctionally-substituted aromatic chelating agents are also useful in the compositions herein. See U.S. Pat. No. 3,812,044, issued May 21, 1974, to Connor et al. Preferred compounds of this type in acid form are dihydroxydisulfobenzenes such as 1,2-dihydroxy -3,5-disulfobenzene.

A preferred biodegradable chelator for use herein is ethylenediamine disuccinate ("EDDS"), as described in U.S. Pat. No. 4,704,233, Nov. 3, 1987, to Hartman and Perkins.

If utilized, these chelating agents will generally comprise from about 0.1% to about 10% by weight of the detergent compositions herein. More preferably, if utilized, the chelating agents will comprise from about 0.1% to about 3.0% by weight of such compositions.

Clay Soil Removal/Antiredeposition Agents

The compositions of the present invention can also optionally contain water-soluble ethoxylated amines having clay soil removal and anti-redeposition properties. Granular detergent compositions which contain these compounds typically contain from about 0.01% to about 10.0% by weight of the water-soluble ethoxylated amines; liquid detergent compositions typically contain about 0.01% to about 5%.

The most preferred soil release and anti-redeposition agent is ethoxylated tetraethylenepentamine. Exemplary ethoxylated amines are further described in U.S. Pat. No. 4,597,898, VanderMeer, issued Jul. 1, 1986. Another group of preferred clay soil removal/antiredeposition agents are the cationic compounds disclosed in European Patent Application 111,965, Oh and Gosselink, published Jun. 27, 1984. Other clay soil removal/antiredeposition agents which can be used include the ethoxylated amine polymers disclosed in European Patent Application 111,984, Gosselink, published Jun. 27, 1984; the zwitterionic polymers disclosed in European Patent Application 112,592, Gosselink, published Jul. 4, 1984; and the amine oxides disclosed in U.S. Pat. No. 4,548,744, Connor, issued Oct. 22, 1985. Other clay soil removal and/or anti redeposition agents known in the art can also be utilized in the compositions herein. Another type of preferred anti-redeposition agent includes the carboxy methyl cellulose (CMC) materials. These materials are well known in the art.

Polymeric Dispersing Agents

Polymeric dispersing agents can advantageously be utilized at levels from about 0.1% to about 7%, by weight, in the compositions herein. These materials can also aid in calcium and magnesium hardness control. Suitable polymeric dispersing agents include polymeric polycarboxylates and polyethylene glycols, although others known in the art can also be used. It is believed, though it is not intended to be limited by theory, that polymeric dispersing agents enhance overall detergent builder performance, when used in combination with other builders (including lower molecular weight polycarboxylates) by crystal growth inhibition, particulate soil release peptization, and anti-redeposition.

Polymeric polycarboxylate materials can be prepared by polymerizing or copolymerizing suitable unsaturated monomers, preferably in their acid form. Unsaturated monomeric acids that can be polymerized to form suitable polymeric polycarboxylates include acrylic acid, maleic acid (or maleic anhydride), fumaric acid, itaconic acid, aconitic acid, mesaconic acid, citraconic acid and methylenemalonic acid. The presence in the polymeric polycarboxylates herein of monomeric segments, containing no carboxylate radicals such as vinylmethyl ether, styrene, ethylene, etc. is suitable provided that such segments do not constitute more than about 40% by weight.

Particularly suitable polymeric polycarboxylates can be derived from acrylic acid. Such acrylic acid-based polymers which are useful herein are the water-soluble salts of polymerized acrylic acid. The average molecular weight of such polymers in the acid form preferably ranges from about 2,000 to 10,000, more preferably from about 4,000 to 7,000 and most preferably from about 4,000 to 5,000. Water-soluble salts of such acrylic acid polymers can include, for example, the alkali metal, ammonium and substituted ammonium salts. Soluble polymers of this type are known materials. Use of polyacrylates of this type in detergent compositions has been disclosed, for example, in Diehl, U.S. Pat. No. 3,308,067, issued Mar. 7, 1967.

Acrylic/maleic-based copolymers may also be used as a preferred component of the dispersing/antiredeposition agent. Such materials include the water-soluble salts of copolymers of acrylic acid and maleic acid. The average molecular weight of such copolymers in the acid form preferably ranges from about 2,000 to 100,000, more preferably from about 5,000 to 75,000, most preferably from about 7,000 to 65,000. The ratio of acrylate to maleate segments in such copolymers will generally range from about 30:1 to about 1:1, more preferably from about 10:1 to 2:1. Water-soluble salts of such acrylic acid/maleic acid copolymers can include, for example, the alkali metal, ammonium and substituted ammonium salts. Soluble acrylate/maleate copolymers of this type are known materials which are described in European Patent Application No. 66915, published Dec. 15, 1982.

Another polymeric material which can be included is polyethylene glycol (PEG). PEG can exhibit dispersing agent performance as well as act as a clay soil removal-/antiredeposition agent. Typical molecular weight ranges for these purposes range from about 500 to about 100,000, preferably from about 1,000 to about 50,000, more preferably from about 1,500 to about 10,000.

Polyaspartate and polyglutamate dispersing agents may also be used, especially in conjunction with zeolite builders.

Brightener

Any optical brighteners or other brightening or whitening agents known in the art can be incorporated at levels typically from about 0.05% to about 1.2%, by weight, into the detergent compositions herein. Commercial optical brighteners which may be useful in the present invention can be classified into subgroups which include, but are not necessarily limited to, derivatives of stilbene, pyrazoline, coumarin, carboxylic acid, methinecyanines, dibenzothiphene-5,5-dioxide, azoles, 5- and 6-membered-ring heterocycles, and other miscellaneous agents. Examples of such brighteners are disclosed in "The Production and Application of Fluorescent Brightening Agents", M. Zahradnik, Published by John Wiley & Sons, New York (1982).

Specific examples of optical brighteners which are useful in the present compositions are those identified in U.S. Pat. No. 4,790,856, issued to Wixon on Dec. 13, 1988. These brighteners include the PHORWHITE series of brighteners from Verona. Other brighteners disclosed in this reference include: Tinopal UNPA, Tinopal CBS and Tinopal 5BM; available from Ciba-Geigy; Arctic White CC and Artic White CWD, available from Hilton-Davis, located in Italy; the 2-(4-styrylphenyl)-2H- naphthol[1,2-d]triazoles; 4,4'-bis- (1,2,3-triazol-2-yl)-stil-benes; 4,4'-bis-(styryl)bisphenyls; and the y-aminocoumarins. Specific examples of these brighteners include 4-methyl-7-diethyl-amino coumarin; 1,2-bis(-benzimidazol-2-yl)ethylene; 1,3-diphenylphrazolines; 2,5-bis(benzoxazol-2-yl)thiophene; 2-styryl-naphth-[1,2-d]oxazole; and 2-(stilbene-4-yl)-2H-naphtho- [1,2-d]triazole. See also U.S. Pat. No. 3,646,015, issued Feb. 29, 1972 to Hamilton.

Suds Suppressors

Compounds for reducing or suppressing the formation of suds can be incorporated into the compositions of the present invention. The incorporation of such materials, hereinafter "suds suppressors," can be desirable to further reduce the already-low sudsing of the mixed surfactant systems herein. As noted above, the use of additional suds suppression can be of particular importance when the detergent compositions herein optionally include a relatively high sudsing surfactant in combination with the low-sudsing polyhydroxy fatty acid amide surfactants of this invention.

A wide variety of materials may be used as suds suppressors, and suds suppressors are well known to those skilled in the art. See, for example, Kirk Othmer Encyclopedia of Chemical Technology, Third Edition, Volume 7, pages 430–447 (John Wiley & Sons, Inc., 1979). One category of suds suppressor of particular interest encompasses monocarboxylic fatty acids and soluble salts therein. See U.S. Pat. No. 2,954,347, issued Sep. 27, 1960 to Wayne St. John. The monocarboxylic fatty acids and salts thereof used as suds suppressor typically have hydrocarbyl chains of 10 to about 24 carbon atoms, preferably 12 to 18 carbon atoms. Suitable salts include the alkali metal salts such as sodium, potassium, and lithium salts, and ammonium and alkanolammonium salts.

The detergent compositions herein may also contain non-surfactant suds suppressors. These include, for example: high molecular weight hydrocarbons such as paraffin, fatty acid esters (e.g., fatty acid triglycerides), fatty acid esters of monovalent alcohols, aliphatic $C_{18}$–$C_{40}$ ketones (e.g. stearone), etc. Other suds inhibitors include N-alkylated amino triazines such as tri-to hexa-alkylmelamines or di- to tetra-alkyldiamine chlortriazines formed as products of cyanuric chloride with two or three moles of a primary or secondary amine containing 1 to 24 carbon atoms, propylene oxide, and monostearyl phosphates such as monostearyl alcohol phosphate ester and monostearyl di-alkali metal (e.g. K, Na, and Li) phosphates and phosphate esters. The hydrocarbons such as paraffin and haloparaffin can be utilized in liquid form. The liquid hydrocarbons will be liquid at room temperature and atmospheric pressure, and will have a pour point in the range of about −40° C. and about 5° C., and a minimum boiling point not less than about 110° C. (atmospheric pressure). It is also known to utilize waxy hydrocarbons, preferrably having a melting point below about 100° C. The hydrocarbons constitute a preferred category of suds suppressor for detergent compositions. Hydrocarbon suds suppressors are described, for example, in U.S. Pat. No. 4,265,779, issued May 5, 1981 to Gandolfo et al. The hydrocarbons, thus, include aliphatic, alicyclic, aromatic, and heterocyclic saturated or unsaturated hydrocarbons having from about 12 to about 70 carbon atoms. The term "paraffin," as used in this suds suppressor discussion, is intended to include mixtures of true paraffins and cyclic hydrocarbons.

Another preferred category of non-surfactant suds suppressors comprises silicone suds suppressors. This category includes the use of polyorganosiloxane oils, such as polydimethylsiloxane, dispersions or emulsions of polyorganosiloxane oils or resins, and combinations of polyorganosiloxane with silica particles wherein the polyorganosiloxane is chemisorbed of fused onto the silica. Silicone suds suppressors are well known in the art and are, for example, disclosed in U.S. Pat. No. 4,265,779, issued May 5, 1981 to Gandolfo et al and European Patent Application No. 89307851.9, published Feb. 7, 1990, by Starch, M. S.

Other silicone suds suppressors are disclosed in U.S. Pat. No. 3,455,839 which relates to compositions and processes for defoaming aqueous solutions by incorporating therein small amounts of polydimethylsiloxane fluids.

Mixtures of silicone and silanated silica are described, for instance, in German Patent Application DOS 2,124,526. Silicone defoamers and suds controlling agents in granular detergent compositions are disclosed in U.S. Pat. No. 3,933,672, Bartolotta et al, and in U.S. Pat. No. 4,652,392, Baginski et al, issued Mar. 24, 1987.

An exemplary silicone based suds suppressor for use herein is a suds suppressing amount of a suds controlling agent consisting essentially of:

(i) polydimethylsiloxane fluid having a viscosity of from about 20 cs. to about 1500 cs. at 25° C.;

(ii) from about 5 to about 50 parts per 100 parts by weight of (i) of siloxane resin composed of $(CH_3)_3SiO_{\frac{1}{2}}$ units of $SiO_2$ units in a ratio of from $(CH_3)_3SiO_{\frac{1}{2}}$ units and to $SiO_2$ units of from about 0.6:1 to about 1.2:1; and (iii) from about 1 to about 20 parts per 100 parts by weight of (i) of a solid silica gel;

In the preferred silicone suds suppressor used herein, the solvent for a continuous phase is made up of polyethylene glycols or polyethylene-polypropylene glycol copolymers or mixtures thereof (preferred), and not polypropylene glycol. The primary silicone suds suppressor is branched/crosslinked and not linear.

To illustrate this point further, typical liquid laundry detergent compositions with controlled suds will optionally comprise from about 0.001 to about 1, preferably from about 0.01 to about 0.7, most preferably from abut 0.05 to about 0.5, weight percent of said silicone suds suppressor, which comprises: (1) a nonaqueous emulsion of a primary antifoam agent which is a mixture of (a) a polyorganosiloxane, (b) a resinous siloxane or a silicone resin-producing silicone compound, (c) a finely divided filler material, and (d) a catalyst to promote the reaction of mixture components (a), (b) and (c), to form silanolates; (2) at least one nonionic silicone surfactant; and (3) polyethylene glycol or a copolymer of polyethylene-polypropylene glycol having a solubility in water at room temperature of more than about 2 weight %; and without polypropylene glycol. Similar amounts can be used in granular compositions, gels, etc. See also U.S. Pat. Nos. 4,978,471, Starch, issued Dec. 18, 1990, and 4,983,316, Starch, issued Jan. 8, 1991, and U.S. Pat. Nos. 4,639,489 and 4,749.740, Aizawa et al at column 1, line 46 through column 4, line 35.

The silicone suds suppressor herein preferably comprises polyethylene glycol and a copolymer of polyethylene glycol/polypropylene glycol, all having an average molecular weight of less than about 1,000, preferably between about 100 and 800. The polyethylene glycol and polyethylene/polypropylene copolymers herein have a solubility in water at room temperature of more than about 2 weight %, preferably more than about 5 weight %.

The preferred solvent herein is polyethylene glycol having an average molecular weight of less than about 1,000, more preferably between about 100 and 800, most preferably between 200 and 400, and a copolymer of polyethylene glycol/polypropylene glycol, preferably PPG 200/PEG 300. Preferred is a weight ratio of between about 1:1 and 1:10, most preferably between 1:3 and 1:6, of polyethylene glycol:copolymer of polyethylene-polypropylene glycol.

The preferred silicone suds suppressors used herein do not contain polypropylene glycol, particularly of 4,000 molecular weight. They also preferably do not contain block copolymers of ethylene oxide and propylene oxide, like PLURONIC L101.

Other suds suppressors useful herein comprise the secondary alcohols (e.g., 2-alkyl alkanols) and mixtures of such alcohols with silicone oils, such as the silicones disclosed in U.S. Pat. Nos. 4,798,679, 4,075,118 and EP 150,872. The secondary alcohols include the $C_6$–$C_{16}$ alkyl alcohols having a $C_1$–$C_{16}$ chain. A preferred alcohol is 2-butyl octanol, which is available from Condea under the trademark ISOFOL 12. Mixtures of secondary alcohols are available under the trademark ISALCHEM 123 from Enichem. Mixed suds suppressors typically comprise mixtures of alcohol+silicone at a weight ratio of 1:5 to 5:1.

For any detergent compositions to be used in automatic laundry washing machines, suds should not form to the extent that they overflow the washing machine. Suds suppressors, when utilized, are preferably present in a "suds suppressing amount." By "suds suppressing amount" is meant that the formulator of the composition can select an amount of this suds controlling agent that will sufficiently control the suds to result in a low-sudsing laundry detergent for use in automatic laundry washing machines.

The compositions herein will generally comprise from 0% to about 5% of suds suppressor. When utilized as suds suppressors, monocarboxylic fatty acids, and salts thereof, will be present typically in amounts up to about 5%, by weight, of the detergent composition. Preferably, from about 0.5% to about 3% of fatty monocarboxylate suds suppressor is utilized. Silicone suds suppressors are typically utilized in amounts up to about 2.0%, by weight, of the detergent composition, although higher amounts may be used. This upper limit is practical in nature, due primarly to concern with keeping costs minimized and effectiveness of lower amounts for effectively controlling sudsing. Preferably from about 0.01% to about 1% of silicone suds suppressor is used, more preferably from about 0.25% to about 0.5%. As used herein, these weight percentage values include any silica that may be utilized in combination with polyorganosiloxane, as well as any adjunct materials that may be utilized. Monostearyl phosphate suds suppressors are generally utilized in amounts ranging from about 0.1% to about 2%, by weight, of the composition. Hydrocarbon suds suppressors are typically utilized in amounts ranging from about 0.01% to about 5.0%, although higher levels can be used.

In addition to the foregoing ingredients which are generally employed in fabric laundry, dishwashing and hard surface cleaners for cleansing and sanitizing purposes, the low sudsing compositions herein can also be used with a variety of other adjunct ingredients which provide still other benefits in various compositions within the scope of this invention. The following illustrates a variety of such adjunct ingredients, but is not intended to be limiting therein.

Fabric Softeners

Various through-the-wash fabric softeners, especially the impalpable smectite clays of U.S. Pat. No. 4,062,647, Storm and Nirschl, issued Dec. 13, 1977, as well as other softener clays known in the art, can be used typically at levels of from about 0.5% to about 10% by weight in the present compositions to provide fabric softener benefits concurrently with fabric cleaning. The polyhydroxy fatty acid amides of the present invention cause less interference with the softening performance of the clay than do the common polyethylene oxide nonionic surfactants of the art. Clay softeners can be used in combination with amine and cationic softeners, as disclosed, for example, in U.S. Pat. No. 4,375,416, Crisp et al, Mar. 1, 1983 and U.S. Pat. No. 4,291,071, Harris et al, issued Sep. 22, 1981.

Other Ingredients

A wide variety of other ingredients useful in detergent compositions can be included in the compositions herein, including other active ingredients, carriers, hydrotropes, processing aids, dyes or pigments, solvents for liquid formulations, etc.

Various detersive ingredients employed in the present compositions advantageously can be stabilized by absorbing said ingredients onto a porous hydrophobic substrate, then coating said substrate with a hydrophobic coating. Preferably, the detersive ingredient is admixed with a surfactant before being absorbed into the porous substrate. In use, the detersive ingredient is released from the substrate into the aqueous washing liquor, where it performs its intended detersive function.

To illustrate this technique in more detail, a porous hydrophobic silica (trademark SIPERNAT D10, DeGussa) is admixed with a proteolytic enzyme solution containing 3%-5% of $C_{13-15}$ ethoxylated alcohol EO(7) nonionic surfactant. Typically, the enzyme/surfactant solution is 2.5×the weight of silica. The resulting powder is dispersed with stirring in silicone oil (various silicone oil viscosities in the range of 500-12,500 can be used). The resulting silicone oil dispersion is emulsified or otherwise added to the final detergent matrix. By this means, ingredients such as the aforementioned enzymes, bleaches, bleach activators, bleach catalysts, photoactivators, dyes, fluorescers, fabric conditioners and hydrolyzable surfactants can be "protected" for use in detergents, including liquid laundry detergent compositions.

Liquid detergent compositions can contain water and other solvents as carriers. Low molecular weight primary or secondary alcohols exemplified by methanol, ethanol, propanol, and isopropanol are suitable. Monohydric alcohols are preferred for solubilizing surfactant, but polyols such as those containing from 2 to about 6 carbon atoms and from 2 to about 6 hydroxy groups (e.g., 1,3-propanediol, ethylene glycol, glycerine, and 1,2-propanediol) can also be used.

Formulations

The formulation of effective, modern detergent compositions poses a considerable challenge, especially in the absence of phosphate builders. For fabric laundering, the formulator is required to address the removal of a wide variety of soils and stains, many of which are termed "greasy/oily" soils, such as foods, cosmetics, motor oil, and the like, from a wide variety of fabric surfaces and under a spectrum of usage conditions, ranging from boil wash temperatures preferred by some users to laundering temperatures as cold as 5° C. preferred by others. Local factors, especially water hardness levels and the presence or absence of metal cations such as iron in local wash water supplies, can dramatically impact detergency performance.

It will be appreciated by the formulators of detergent compositions that, at sufficiently low interfacial tensions, it is theoretically possible to provide what might be termed "spontaneous emulsification" of greasy/oily soil. If such spontaneous emulsification were to be secured, it would very considerably enhance grease/oil removal from substrates such as fabrics, dishware, environmental hard surfaces, and the like. While extremely low interfacial tensions and, presumably, spontaneous emulsification, have possibly been achievable with specialized surfactants such as the fluorinated surfactants known in the art, the present invention al so approaches and/or achieves this desirable result, and with low suds levels, especially when fatty acids, e.g., as auxiliary suds suppressors, and calcium ions are present. Preferably, if such compositions contain builders they will be selected from the non-phosphate builders, especially citrate, zeolite and layered silicate.

It will further be appreciated that, while the calcium and/or optional magnesium ions may be incorporated into the compositions herein, the formulator may determine that it is acceptable practice to rely on natural water hardness to provide such ions to the compositions under in-use situations. This may be a reasonable expedient, since as little as 2 gr/gal calcium hardness can provide substantial benefits, especially if a weak builder is used. However, the formulator will most likely decide to add the calcium and/or optional magnesium ions directly to the compositions, thereby assuring their presence in the in-use situation.

Calcium and Magnesium Source

The compositions herein may optionally contain from about 0.1% to about 4%, preferably from about 0.5% to about 2%, by weight, of calcium ions, magnesium ions, or both. Sources of calcium and magnesium can be any convenient water-soluble and toxicologically acceptable salt, including but not limited to, $CaCl_2$, $MgCl_2$, $Ca(OH)_2$, $Mg(OH)_2$, $CaBr_2$, $MgBr_2$, $CaSO_4$ and $MgSO_4$, Ca malate, Mg malate, Ca maleate, Mg maleate, or the calcium or magnesium salts of anionic surfactants or hydrotropes. $CaCl_2$ and $MgCl_2$ are convenient.

Formulation Variables

The sudsing levels of the compositions herein can be further modified by pH effects. Typically, lower sudsing is achieved at higher pH's, i.e., pH 8, 9 and above. Suds levels are much lower at high water hardness levels (i.e., above about 10 grain/gallon) and the use of $Ca^{++}$, as noted above, can then advantageously also be used to decrease sudsing if low wash-water hardness is encountered. Underbuilt formulations, i.e., with citrate, zeolite or layered silicate builders, will often allow sufficient residual hardness ions to diminish sudsing and such builders are thus preferred herein.

The detergent compositions herein will preferably be formulated such that during use in aqueous cleaning operations, the wash water will have a pH of between about 6.5 and about 11, preferably between about 7.5 and about 10.5. Liquid product formulations preferably have a pH between about 7.5 and about 9.5, more preferably between about 7.5 and about 9.0. Techniques for controlling pH at recommended usage levels include the use of buffers, alkalis, acids, etc., and are well known to those skilled in the art.

The following Examples further illustrate the practice of this invention by providing typical low-sudsing laundry detergent compositions, but are not intended to be limiting thereof. In the Examples, the optional ingredients may be selected from various cleaning materials noted above, or taken from standard formularies. In the event simplified formulations are desired, the optional ingredients may be deleted, which results in a corresponding mathematical change in the percentages of the other listed ingredients.

EXAMPLE I

A heavy-duty, low sudsing built laundry detergent suitable for use in front-loading European fabric washing machines is as follows.

| Ingredient | % (Wt.) |
|---|---|
| $C_{14-15}$ alcohol sulfate (Na) | 6.30 |
| $C_{14-15}$ alkyl ether (2.25) sulfate (Na) | 1.60 |
| Lauroyl N-n-propyl glucamide | 4.50 |
| $C_{12}$-$C_{15}$ alcohol ethoxlates (3.0) (NEODOL 25-3) | 4.50 |

-continued

| Ingredient | % (Wt.) |
|---|---|
| Zeolite A (aluminosilicate) builder (1-10 micron) | 13.40 |
| Crystalline layered silicate builder* | 13.00 |
| Citric acid | 3.50 |
| Sodium carbonate | 13.00 |
| Acrylic acid-maleic acid copolymer | 3.60 |
| Perborate monohydrate | 18.20 |
| Tetraacetyl ethylenediamine | 7.80 |
| Savinase (6.0T) enzyme | 2.20 |
| Lipolase (100,000 LU/g) enzyme | 0.60 |
| Cellulase (3800 CEVU) enzyme | 0.20 |
| Optional (soil release polymer, bleaches, brighteners, perfume, silicone suds suppressor, etc.) | Balance 100.00 |

*Available as SKS6.

EXAMPLE II

A low-sudsing laundry detergent for use in top-loading American fabric washing machines is as follows:

| Ingredient | % (Wt.) |
|---|---|
| $C_{14-15}$ alcohol sulfate (Na) | 13.40 |
| $C_{14-15}$ alkyl ether (2.25) sulfate (Na) | 2.70 |
| Lauroyl N-n-propyl glucamide | 2.70 |
| Zeolite A (aluminosilicate) | 26.30 |
| Citric acid | 3.00 |
| Sodium carbonate | 21.10 |
| Sodium sulfate | 10.11 |
| Polyacrylate (MW 4500) | 3.40 |
| Silicate | 2.23 |
| Savinase (6.0T) enzyme | 1.06 |
| Other (bleaches, brighteners, perfume, fatty acid or silicone suds suppressor, etc.) | Balance 100.00 |

EXAMPLE III

A low sudsing liquid laundry detergent is as follows.

| Ingredients | % (wt.) |
|---|---|
| $C_{14}$-$C_{15}$ $(EO)_3$ sulfate, Na | 12.0* |
| $C_{12}$-$C_{13}$ alkyl sulfate, Na | 6.0* |
| $C_{12}$-$C_{14}$ ethoxylate $(EO)_7$ | 5.0 |
| $C_{12}$-N-n-propyl glucamide | 9.0 |
| Palm kernel fatty acids** | 9.0 |
| Citric acid (anhyd.) | 6.0 |
| Monoethanolamine | 11.2 |
| Ethanol | 5.0 |
| 1,2-propanediol | 12.0 |
| Water | Balance |

-continued

| Ingredients | % (wt.) |
|---|---|
| Product pH | to 7.8 |

*Percentages calculated on basis of the acid form of the surfactant.
**Typical chain length distribution, mainly $C_{12}$-$C_{14}$.

EXAMPLE IV

The compositions of Examples I and III are, respectively, modified by replacing the N-n-propyl glucamide surfactant with an equivalent amount of the corresponding N-n-butyl, N-isobutyl, and N-n-hexyl polyhydroxy fatty acid amide surfactants to achieve low sudsing compositions.

EXAMPLE V

The suds volume of the composition of Example I is lowered still further by the addition of 0.5% of a silica/silicone suds suppressor. Use of the N-hexyl glucamide surfactant to replace the N-propyl glucamide is acceptable in this composition.

The foregoing disclosure and Examples illustrate the practice of this invention in considerable detail. It is to be appreciated, however, that the advantages afforded by the compositions and processes of this invention are broadly useful with a variety of other technologies which have been developed for use in a wide variety of modern, fully-formulated cleaning compositions, especially laundry detergents. The compositions herein will typically be used in aqueous media at concentrations of typically at least about 100 ppm, e.g., for lightly-soiled fabrics and/or hand dishwashing. Higher usage concentrations in the range of 1,000 ppm to 8,000 ppm, and higher, are used for heavily-soiled fabrics. However, usage levels can vary, depending on the desires of the user, soil loads, soil types, and the like. Wash temperatures can range from 5° C. to the boil.

What is claimed is:

1. A method for cleaning fabrics in an automatic washing machine without excess sudsing, comprising contacting the fabrics to be laundered with an aqueous solution comprising at least 100 ppm of a low sudsing detergent composition which comprises at least about 2% by weight of an N-hexyl polyhydroxy fatty acid amide surfactant of the formula

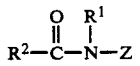

wherein $R^1$ is hexyl, $R^2$ is $C_9$-$C_{17}$alkyl and Z is $-(CH_2(CHOH)_4CH_2OH$ and from about 3% to about 60% by weight of an auxiliary anionic surfactant selected from the group consisting of $C_{11}$-$C_{16}$ alkyl benzene sulfonates, $C_{12}$-$C_{18}$ primary and secondary alkyl and alkenyl sulfates, and $C_{10}$-$C_{18}$ alkyl alkoxy sulfates.

* * * * *